US006392554B1

(12) United States Patent
Lee et al.

(10) Patent No.: US 6,392,554 B1
(45) Date of Patent: May 21, 2002

(54) ELECTROMAGNETIC WAVE ISOLATION APPARATUS FOR USE IN MULTI-OUTLETS

(76) Inventors: Beom Jae Lee, Na-102 Joongang Heights Villa, 355-1 Juk-ri, Daeduk-myon, Ansung-shi, Kyonggi-do (KR), 456-830; Kye Sam Kim, B-402 Hyung-Jae Apartment, 615-103 Panghwa-2dong, Kangso-gu, Seoul (KR), 157-220

( * ) Notice: Subject to any disclaimer, the term of this patent is extended or adjusted under 35 U.S.C. 154(b) by 0 days.

(21) Appl. No.: 09/748,116

(22) Filed: Dec. 27, 2000

(30) Foreign Application Priority Data

Sep. 16, 2000 (KR) ..... 00-54487

(51) Int. Cl.[7] ..... G08B 21/00

(52) U.S. Cl. ..... 340/657; 340/649; 340/310.03; 324/67

(58) Field of Search ..... 340/657, 649, 340/650, 664, 310.01, 310.03; 324/67, 326; 361/103, 42, 118, 106

(56) References Cited

U.S. PATENT DOCUMENTS 4,652,861 A * 3/1987 Domes ..... 340/539
4,686,454 A * 8/1987 Pecukonis ..... 324/67
5,309,310 A * 5/1994 Baer et al. ..... 361/42
6,104,590 A * 8/2000 Schmidt ..... 361/118
6,140,819 A * 10/2000 Peterman et al. ..... 324/326

* cited by examiner

*Primary Examiner*—Daniel J. Wu
*Assistant Examiner*—Phung Nguyen
(74) *Attorney, Agent, or Firm*—Lowe Hauptman Gilman & Berner, LLP

(57) ABSTRACT

An electromagnetic wave isolation apparatus is provided for use in household multi-outlets, which apparatus includes an electromagnetic wave detecting circuit for sensing induced electromagnetic waves generated in the home or office and generating an output signal responsive to a predetermined level of the induced electromagnetic waves. An electromagnetic wave isolation circuit is provided, in response to the output signal of the detecting circuit to generate an output signal for driving a lamp which indicates the presence of electromagnetic waves and subsequently for driving a switch which enables one of AC output lines to be connected with the circuitry ground of the multi-outlet. A switching circuit is also included for activating a second switch provided in each of the AC output lines in response to the output signal of the isolation circuit. A resistor is connected between the circuitry ground and the ground terminal of the power cord of the multi-outlet. Preferably, the electromagnetic wave isolation circuit of this invention includes a buzzer for audibly indicating the presence of electromagnetic waves. The switching circuit includes a relay with its switch interposed between each of the AC output line and the circuitry ground of the multi-outlet. The switching circuit further includes a transistor driving circuit for activating each of the relays.

4 Claims, 5 Drawing Sheets

ELECTROMAGNETIC WAVE ISOLATION APPARATUS FOR USE IN MULTI-OUTLETS

FIELD OF THE INVENTION

This invention relates to an electromagnetic wave isolation apparatus that is suitable to use in household multi-outlets.

BACKGROUND OF THE INVENTION

Nowadays, due to the wide usage of electrical appliances and personal computers in the office or home, use of multi-outlets is indispensable for supplying them with electricity. Some of multi-outlets have many functions such as electrical surge suppression, over current protection, and noise removal function for the safety of the user and electrical appliances, as well as its original power distribution function.

However, in most homes and offices, a significant amount of electromagnetic waves are generated by the use of electrical appliances, for example, refrigerators and the like employing electric motors, and television sets and computer monitors employing high voltage devices.

However, there have been few measures for isolating the electromagnetic waves generated in homes or offices, although electromagnetic waves are known to be harmful to the human body.

As is well known in the art, when electricity flows, electrical and magnetic fields are simultaneously generated around a conductor. A wave motion occurred by the periodic change between the electrical field and magnetic field is referred to as the electromagnetic wave. The electrical field and magnetic field are different from each other in property but they are combined with each other. The electromagnetic wave is generated at any location where electricity flows and thus the electromagnetic wave is inevitably generated in every electrical apparatus.

Further, the electrical field is generated in proportion to the amplitude of voltage, and the magnetic field in proportion to the intensity of electric current. The electrical field may be quite isolated by a material having high conductivity. However, only a ferromagnetic substance or alloys block the magnetic field and it is thus very difficult to isolate the magnetic field.

According to a survey, an amount of electromagnetic waves are found in the home and office space. For example, in a living room of about the size of 33 $m^2$ (where a television set, electric fan, and fluorescence lamps are used) the electrical field intensity is measured to be about 18.6 V/m, and in an office of about 66 $m^2$ (where computers, copying machines, fluorescence lamps, air conditioner, facsimile machine, printer, hot and chilled water dispenser, and a small size refrigerator are located) the electrical field intensity is about 19.1 V/m.

In addition, the amount of electromagnetic wave emission is measured in about 146.8 V/m at a distance of 30 centimeters from a computer set, about 193.1 V/m at a distance of 30 centimeters from a television set, about 193.2 V/m at a distance of 30 centimeters from a refrigerator (230 liters), and about 133.1 V/m at a distance of 30 centimeters from an air conditioner (66 $m^2$ capacity).

Such an electromagnetic wave has been known to increase the temperature of cells of human tissue due to its thermal effect, thus to weaken the immunological function of the human body. The National Cancer Institute has advised that the electromagnetic wave may induce cancer.

Accordingly, with the recent increase for concern about the harmfulness of electromagnetic waves, a strong demand exists for a device capable of isolating and removing the electromagnetic wave occurring in the home and office.

SUMMARY OF THE INVENTION

Therefore, it is an object of this invention to provide an electromagnetic wave isolation apparatus that is incorporated in a multi-outlet used in the home or office.

It is further object of this invention to provide an electromagnetic wave isolation apparatus which may isolate the electromagnetic wave occurring in the home or office in a simple and easy manner.

According to the invention, there is provided an electromagnetic wave isolation apparatus for use in multi-outlets, which apparatus comprises an electromagnetic wave detecting circuit for sensing induced electromagnetic waves generated in the home or office and generating an output signal responsive to a predetermined level of the induced electromagnetic wave; an electromagnetic wave isolation circuit in response to the output signal of the detecting circuit to generate an output signal for driving a lamp which indicates the presence of electromagnetic waves and subsequently for driving a switch which enables one of the AC output lines to be connected with the circuitry ground of the multi-outlet; a switching circuit for activating a second switch provided in each of the AC output lines in response to the output signal of the isolation circuit; and a resistor connected between the circuitry ground and the ground terminal of the power cord of the multi-outlet.

Preferably, the electromagnetic wave isolation circuit of this invention includes a buzzer for audibly indicating the presence of electromagnetic waves, and the lamp is a light emitting diode.

In one embodiment of this invention, the above switching circuit includes a relay with its switch interposed between each of the AC output line and the circuitry ground of the multi-outlet. The switching circuit further includes a transistor driving circuit for activating each of the relays.

Further, a ground pin contact of each receptacle provided in the multi-outlet is commonly connected with the circuitry ground terminal of the electromagnetic wave isolation apparatus through a thermistor.

BRIEF DESCRIPTION OF THE DRAWINGS

The foregoing and other objects, features, and advantages of the invention will be apparent from the following particular description of preferred embodiments as illustrated in the accompanying drawing in which.

DESCRIPTION OF THE PREFERRED EMBODIMENT

Figure 1:
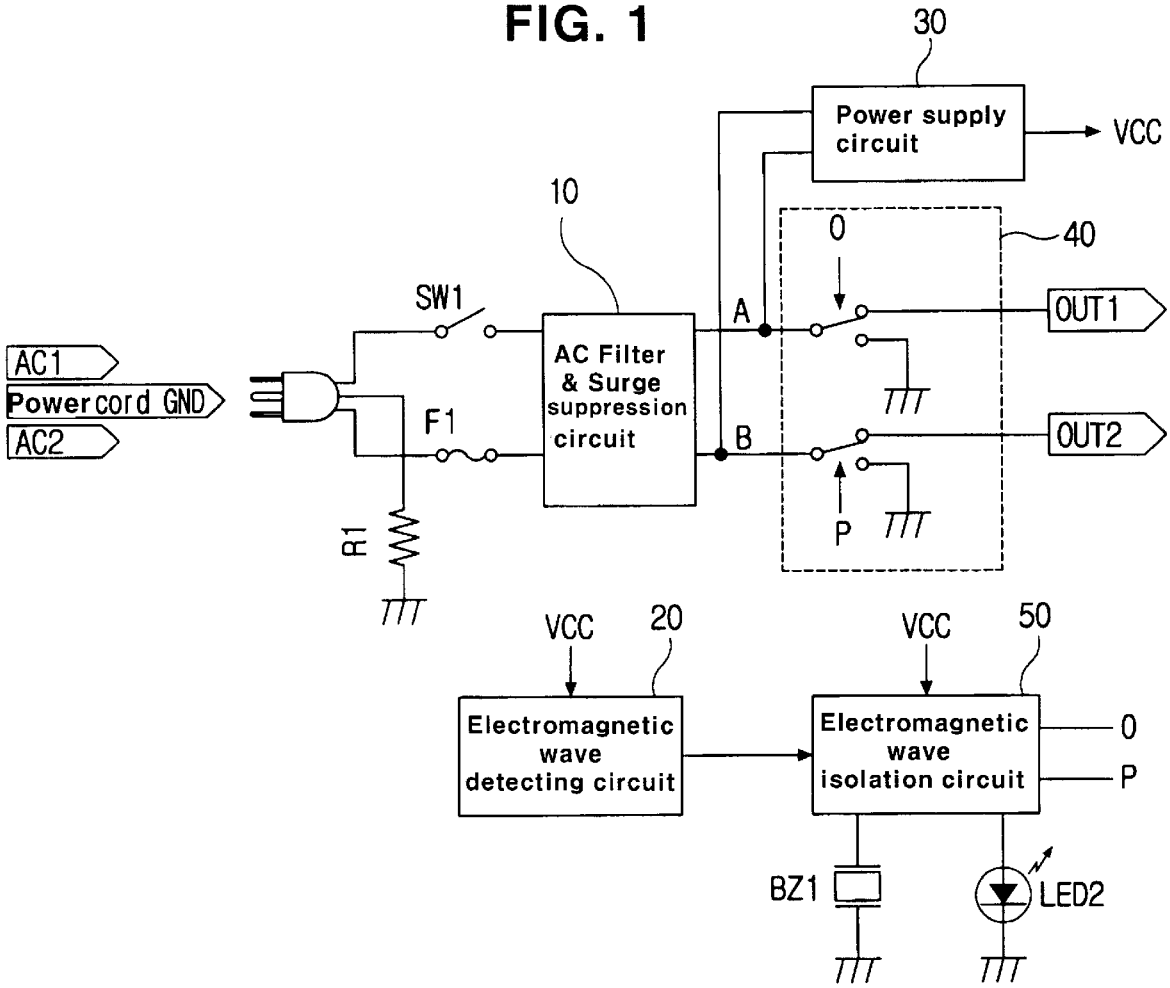
FIG. 1 is a block diagram showing a configuration of an electromagnetic wave isolation apparatus in accordance with the present invention.

A preferred embodiment of the present invention will be explained with reference of the attached drawings in which reference characters refer to the same parts throughout the various drawings.

Referring to FIG. 1, there is shown an electromagnetic wave isolation apparatus according to this invention. Basically, a multi-outlet implementing this invention has a power cord and plug for connecting with alternating current (AC) lines AC1 and AC2 and an exterior ground line GND. Normally, a power switch SW1 is arranged at one AC input line connected to the alternating current line AC1, and a fuse F1 arranged at the other AC input line connected to the alternating current line AC2. Two AC input lines of the multi-outlet are connected through a filter and surge suppression circuit 10 to AC output lines OUT1 and OUT2. The filter and surge suppression circuit 10 is well known in this art and therefore the description thereof will be omitted.

The electromagnetic wave isolation apparatus according to this invention detects an electromagnetic wave generated in the home or office and grounds selectively one of the AC output lines OUT1 and OUT2 to the multi-outlet circuitry ground. The electromagnetic wave induced to one of the alternating current line is passed by resistor R1 to the exterior ground line GND and is thereby removed.

The electromagnetic wave isolation apparatus of the present invention comprises an electromagnetic wave detecting circuit 20, an electromagnetic wave isolation circuit 50, a switching circuit 40, and a power supply circuit 30.

The detecting circuit 20 detects electromagnetic waves generated in the home or office and generates an output signal responsive to a predetermined level of the induced electromagnetic wave.

The electromagnetic wave isolation circuit 50 receives the output signal of the detecting circuit 20 and generates an output signals O or P in order to drive a switch that enables one of AC output lines OUT1 and OUT2 to be connected with the circuitry ground of the multi-outlet. The isolation circuit 50 also generates output-signals for driving a lamp LED2 and a buzzer BZ1 that provides audible and visual indication of the detected electromagnetic wave.

The switching circuit 40 activates the switch provided in each of the AC output lines OUT1 and OUT2 in response to the output signal O, P of the isolation circuit 50.

The power supply circuit 30 converts the AC output source from terminal A, B and supplies an operating voltage Vcc to the above circuits 20, 40, and 50. Finally, a resistor R1 is connected between the circuitry ground and the ground terminal of the power cord of the multi-outlet.

Figure 2:
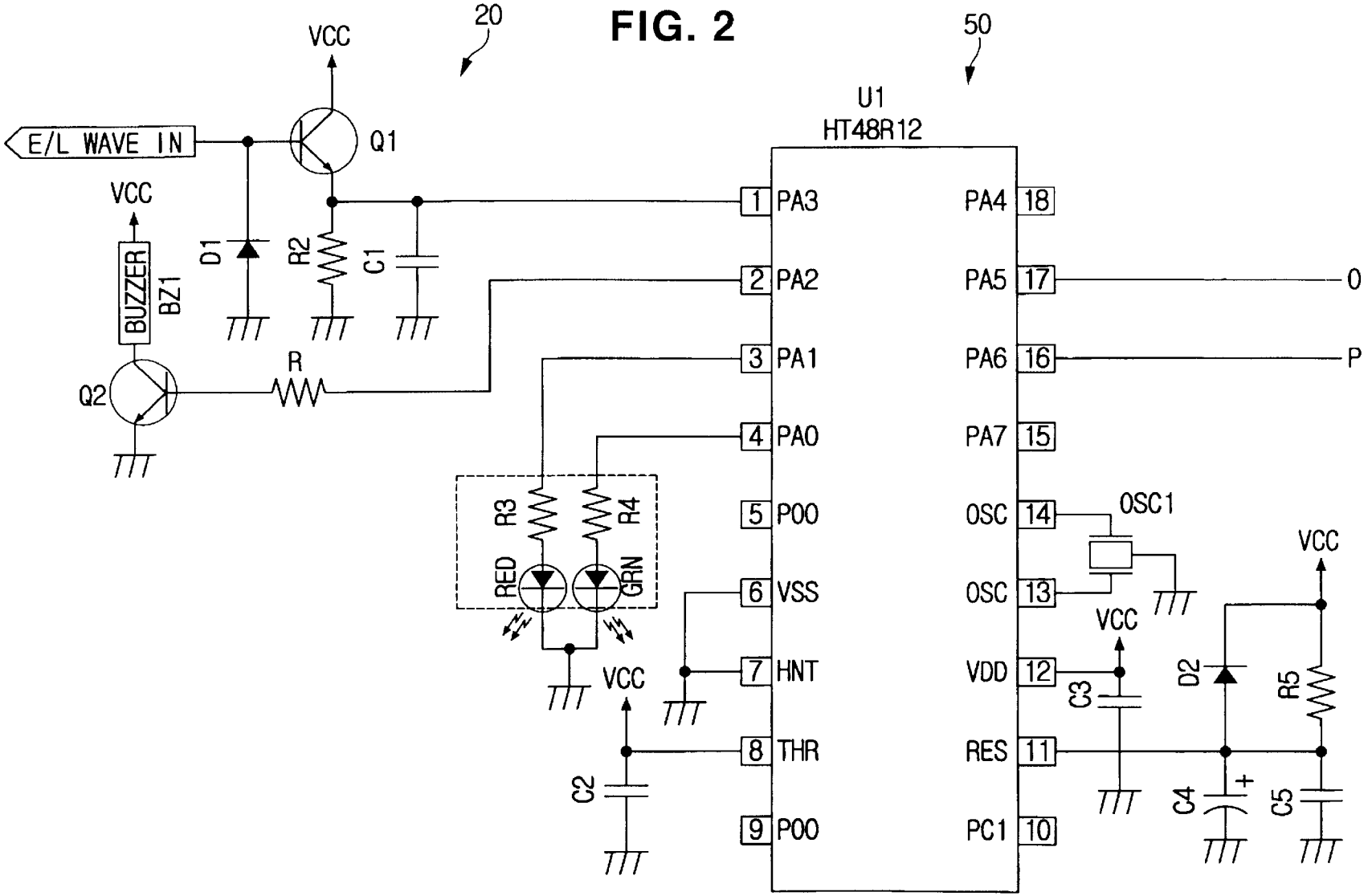
FIG. 2 is a schematic circuit diagram of an electromagnetic wave detecting circuit and an electromagnetic wave isolation circuit shown in FIG. 1.

Referring to FIG. 2, there is shown a detailed circuit diagram of the electromagnetic wave detecting circuit 20 and the electromagnetic wave isolation circuit 50.

The electromagnetic wave detecting circuit 20 includes a transistor Q1, a diode D1, a resistor R2, and a capacitor C1. The base input of transistor Q1 is connected with the cathode terminal of the diode D1 which is grounded at the anode terminal thereof. The emitter of transistor Q1 is connected commonly with one end of the resistor R2 and capacitor C1, which forms output terminal of the detecting circuit 20. The supply voltage Vcc, for example 5 V, is connected to the collector of the transistor Q1.

Sensing of electrical field components in the electromagnetic wave generated in a place is carried out at the open-base input of the transistor Q1. When a pulse shape electrical field component is applied to the base of the transistor Q1, positive component of the electrical field is detected at the cathode terminal of the diode D1. If the detected electrical field voltage level exceeds a predetermined level, it turns on the transistor Q1. Therefore, the emitter output of the transistor Q1 is held at high level (for example, about 1.2 V), and the high-level output signal is supplied to an input terminal of the electromagnetic wave isolation circuit 50.

The electromagnetic wave isolation circuit 50 comprises a microprocessor U1 and its auxiliary external components, i. e., an oscillator OSC1, capacitors C2–C5, diode D2, and resistor R5. The isolation circuit 50 further comprises a buzzer BZ1 and its driving transistor Q2, connected by a resistor R to an output terminal (Pin No. 2) of the microprocessor U1. Also, a set of light emitting diodes RED, GRN are connected by a series resistors R3, R4 to output terminals (Pin Nos. 3 and 4) of the microprocessor U1, respectively. The light emitting diode RED emits red light and the light emitting diodes GRN emits green light according to the high-level output of the terminal Pin Nos. 3 and 4, and these light emitting diodes are incorporated into the device LED 2 shown in FIG. 1.

The microprocessor U1 is preferably of the 8-bit microcontroller, model No. HT48R12, produced by Holtek Semiconductor, Inc., Taiwan, R.O.C. The microprocessor U1 also includes an EEPROM memory (not shown) that stores a program for carrying out the operation of the invention.

The microprocessor U1 receives at the input terminal (Pin No. 1) the output signal of the electromagnetic wave detecting circuit 20.

The microprocessor U1 generates control signals P and O at output terminals (Pin Nos. 16 and 17) in response to the high-level output signal of the electromagnetic wave detecting circuit 20. The control signals P and O are supplied to the switching circuit 40.

The operation of the microprocessor U1 will be explained later with reference to FIG. 5.

Figure 3:
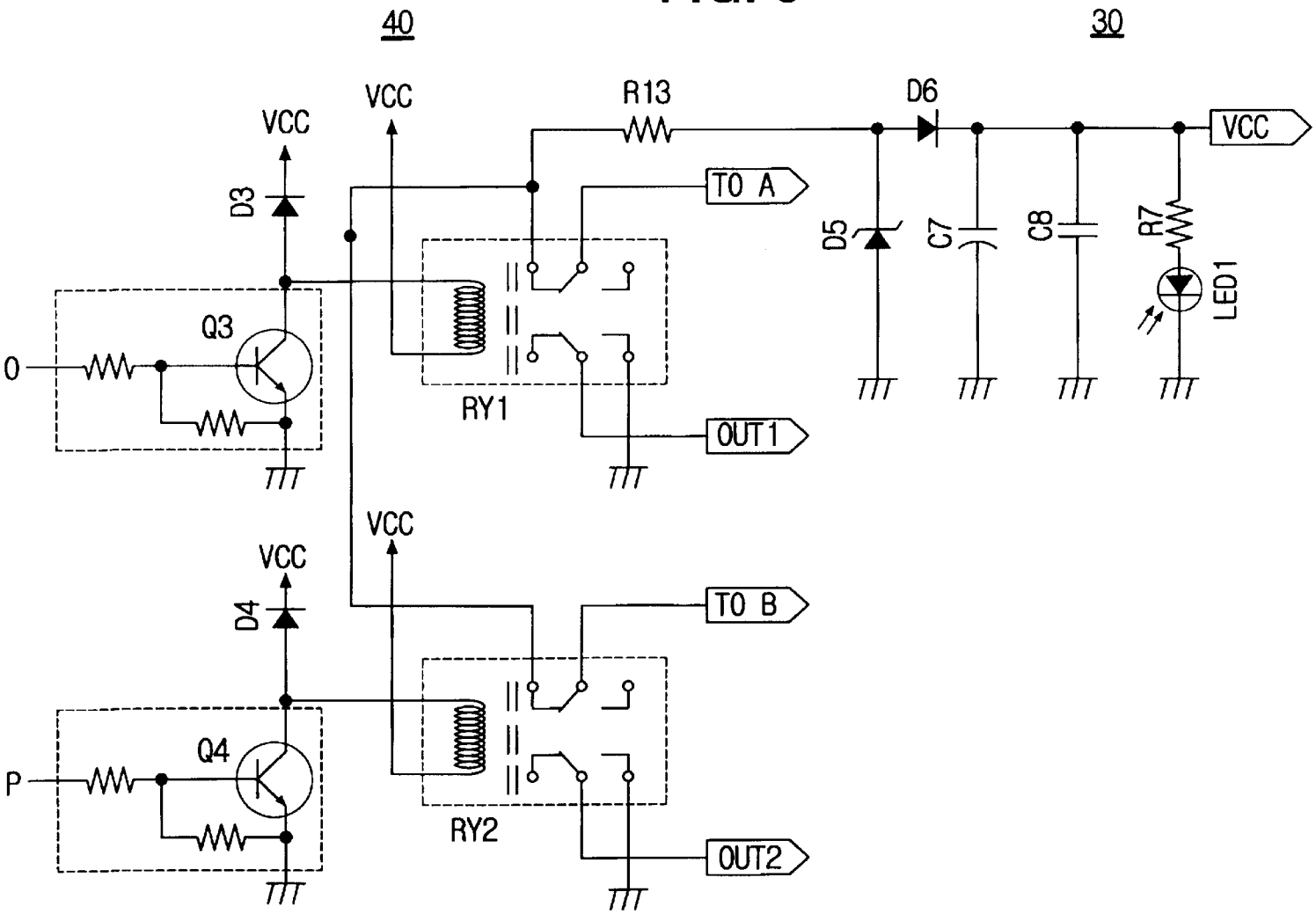
FIG. 3 is a schematic circuit diagram of a power supply circuit and a switching circuit shown in FIG. 1.

FIG. 3 shows a detailed circuit diagram of the switching circuit 40 and the power supply circuit 30. In this embodiment, the switching circuit 40 comprises a pair of relays RY1 and RY2 with their electromagnetic contact switches interposed between the output lines OUT1 and OUT2 and the circuitry ground of the multi-outlet, respectively. The switches of the relays RY1 and RY2 selectively direct one of the two AC output lines OUT1 and OUT2 of the multi-outlet to the circuitry ground. The switching circuit 40 also includes a driving circuit for activating the relays RY1 and RY2.

The driving circuit includes a pair of switching transistors Q3 and Q4 with their bias resistors connected between the respective base terminal and the emitter terminal. The collector of each transistor Q3 and Q4 is connected with the operating voltage Vcc line through diodes D3 and D4.

The switching transistors Q3 and Q4 perform the switching operation relative to the operating voltage Vcc supplied to each actuating coil of the relays RY1 and RY2, in response to the input signal O and P supplied from the output terminals (Pin Nos. 17 and 16) of the microprocessor U1.

The power supply circuit section 30 is a common rectifying and smoothening circuit having resistor R13, a Zener diode D5, a rectifying diode D6, capacitor C7 and C8, as shown in FIG. 3.

The power supply circuit section 30 rectifies and smoothens the AC input current supplied from either one of the AC lines A and B through the contact switches of the relays RY1 and RY2, and generates at the output terminal a direct current ripple voltage Vcc of a predetermined level. This power supply circuit section 30 also includes a power indicator circuit having a resistor R7 and a light emitting diode LED1.

Figure 4:
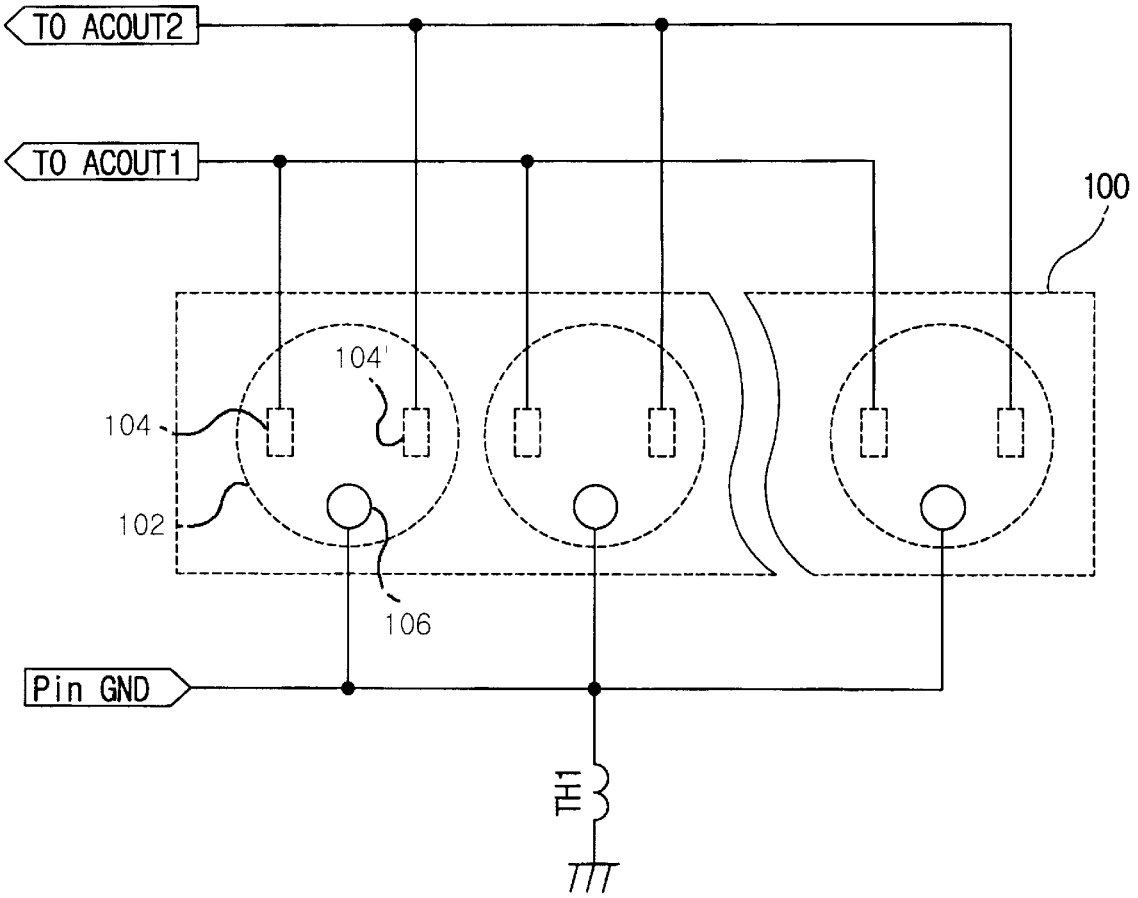
FIG. 4 is a simplified diagram depicting electrical circuitry of a multi-outlet to which this invention is applied.

FIG. 4 is a simplified diagram showing an electrical circuit configuration of the multi-outlet 100 (shown as dotted line) used in this invention. A pair of electrical contacts 104, 104' in every receptacle 102 are connected with the output lines OUT1 and OUT2, respectively. Also, ground pin contact 106 of each receptacle 102 is commonly connected with the circuitry ground terminal of the electromagnetic wave isolation apparatus through a thermistor TH1.

Thus, when an electrical appliances is coupled with a receptacle 102, electromagnetic waves generated in the electrical appliances are introduced through the thermistor TH1 and then the isolating resistor R1 (FIG. 1) into the exterior ground, and thereby eliminating the electromagnetic waves. As mentioned above, the isolating resistor R1 is connected between the circuitry ground and the ground terminal of the power cord GND of the multi-outlet.

Figure 5:
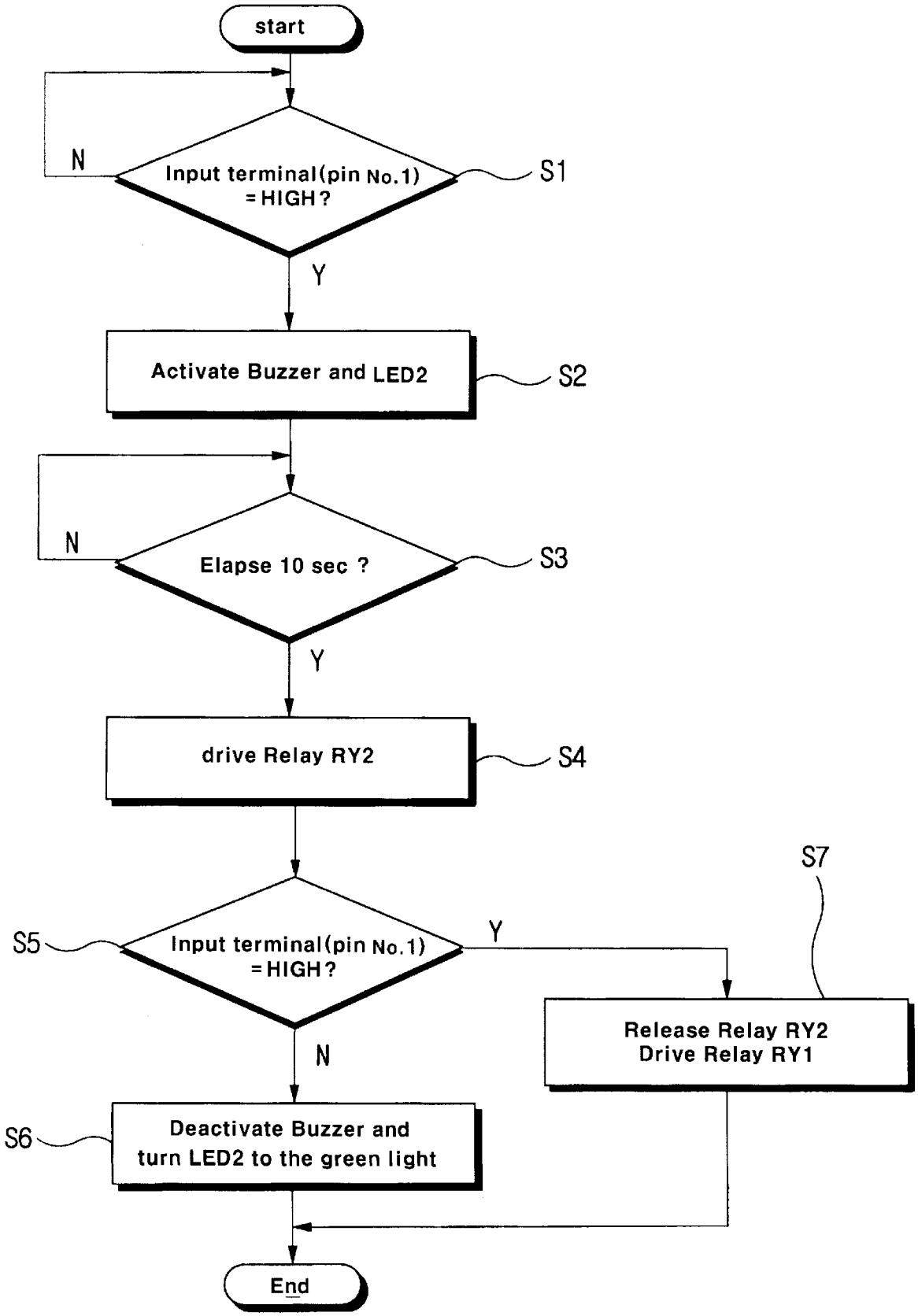
FIG. 5 is a flowchart showing an operation of the microprocessor implemented by the electromagnetic wave isolating circuit shown in FIG. 2.

FIG. 5 shows an isolating operation performed by the microprocessor U1 of the electromagnetic wave isolation circuit 50.

In step S1, it is determined whether the input terminal of the microprocessor U1 receives a high-level signal. The high-level signal indicates the presence of an electromagnetic wave applied to the electromagnetic wave detecting circuit 20.

In the next step S2, if the input terminal of the microprocessor U1 receives a high-level signal, the microprocessor U1 outputs at the terminals (Pin Nos. 2, 3, and 4) thereof signals to activate the buzzer BZ1 and the light emitting diode LED2. At the output terminal (Pin No. 2), 4 MHz pulse signal generated by the oscillator OCS1 is supplied to the buzzer BZ1 and a warning sound is thus generated. At the output terminal (Pin Nos. 3 and 4), a high-level signal is simultaneously supplied to LED2, and both red LED and the green LED are turned on. Thus, LED2 emits yellow color light to indicate the detection status of the electromagnetic wave.

Next, in step S3, the microprocessor U1 determines whether the operating time of the buzzer and LED2 has elapsed 10 seconds by counting the time at the internal counter. If the operating time passes 10 seconds, it proceeds to step S4 to produce a high-level signal P at the output terminal Pin No. 16 for driving the relay RY2. This high-level output signal is applied to the base of the transistor Q4 of the relay driving circuit, and turns on the transistor Q4. Accordingly, the operating voltage Vcc can be applied to the relay RY2 and the relay is activated. This allows the AC output line OUT2 to be switched to the circuitry ground. As the circuitry ground is connected via the resistor R1 to the exterior ground terminal of the power cord GND, the electromagnetic wave being introduced into the AC output line OUT2 can be effectively eliminated.

Again, the microprocessor U1 determines whether an electromagnetic wave is still detected at the input terminal (Pin No. 1) in step 5. If an electromagnetic wave is not detected, it proceeds to step 6 to deactivate the buzzer BZ1 and turn the light emitting diode LED2 to the green light. The microprocessor U1 stops supplying of the 4 MHz pulse signal at the output terminal (Pin No. 2), thus the buzzer BZ1 can be deactivated. Also, it stops supplying of the high-level signal at the output terminal Pin No. 3, while continually supplying a high-level signal at the output terminal Pin No. 4. This allows the LED2 to turn to the green light, indicating the absence of electromagnetic waves around the multi-outlet.

If it is determined that the electromagnetic waves are still detected in step S5, it proceeds to step S7 where the release of the relay RY2 and the drive of the relay RY1 are performed.

In order to drive the relay RY1, the microprocessor U1 produces a high-level signal O at the output terminal Pin No. 17 as similar to step S4. This high-level output signal is applied to the base of the transistor Q3 of the relay driving circuit, and turns on the transistor Q3. This allows the operating voltage Vcc to be applied to the relay RY1 and the AC output line OUT1 to be switched to the circuitry ground. Again, as the circuitry ground is connected via the resistor R1 to the exterior ground terminal of the power cord GND, electromagnetic waves being introduced into the AC output line OUT1 can be effectively eliminated.

As apparent from the foregoing description, the electromagnetic wave isolation apparatus of this invention detects the electromagnetic waves introduced in AC output lines of the multi-outlet, and if detected, it selectively switches one of the AC output lines OUT1 and OUT2 to the circuitry ground. Thus, the electromagnetic waves introduced into the multi-outlet as well as the electromagnetic waves generated in electrical appliances coupled to the multi-outlet can be effectively eliminated.

While the preferred embodiment has been disclosed and described in detail herein, it will be obvious to those skilled in the art that various changes in form and detail may be made therein without departing from the spirit and scope thereof.

What is claimed is:

1. An electromagnetic wave isolation apparatus for use in multi-outlets comprising:

an electromagnetic wave detecting circuit for sensing induced electromagnetic waves in AC input lines of the multi-outlet and outputting a signal representative of the presence of electromagnetic waves;

an electromagnetic wave isolation circuit in response to the output signal of the detecting circuit to generate an output signal for driving a lamp which indicates the presence of electromagnetic waves and subsequently for driving a switch which enables one of AC output lines to be connected with the circuitry ground of the multi-outlet;

a switching circuit for activating a second switch provided in each of the AC output lines in response to the output signal of the isolation circuit; and an isolating resistor connected between the circuitry ground and the ground terminal of the power cord of the multi-outlet.

2. The electromagnetic wave isolation apparatus according to claim 1, wherein the isolation circuit includes a buzzer for audibly indicating the presence of electromagnetic waves, and wherein the lamp is a light emitting diode (LED).

3. The electromagnetic wave isolation apparatus according to claim 1, wherein the switching circuit includes a relay with their switch interposed between each of the AC output line and the circuitry ground of the multi-outlet, and a transistor driving circuit for activating each of the relays.

4. The electromagnetic wave isolation apparatus according to claim 1, wherein a ground pin contact of each receptacle provided in the multi-outlet is commonly connected with the circuitry ground terminal of the electromagnetic wave isolation apparatus through a thermistor.

* * * * *